United States Patent [19]

Rebentisch et al.

[11] 4,277,923

[45] Jul. 14, 1981

[54] SUPPORT PEDESTAL ASSEMBLY FOR A RAISED FLOOR SYSTEM

[75] Inventors: Hugo E. Rebentisch, Garden City; Ellwood Irish, Wayne, both of Mich.

[73] Assignee: Unistrut Corporation, Wayne, Mich.

[21] Appl. No.: 86,207

[22] Filed: Oct. 18, 1979

[51] Int. Cl.[3] ..... E04B 5/43

[52] U.S. Cl. ..... 52/126; 52/301

[58] Field of Search ..... 52/126, 263, 301

[56] References Cited

U.S. PATENT DOCUMENTS

| | | | |
|---|---|---|---|
| 3,150,748 | 9/1964 | Liskey | 52/126 |
| 3,606,704 | 9/1971 | Denton | 52/126 |
| 3,616,584 | 11/1971 | Sartori | 52/126 |
| 3,800,582 | 4/1974 | Sartori | 72/78 |

FOREIGN PATENT DOCUMENTS

| | | | |
|---|---|---|---|
| 291683 | 11/1967 | Australia | 52/126 |

OTHER PUBLICATIONS

Liskey Access Floor "Systems" Liskey Aluminum Inc., Baltimore Md., 1975, 5 pages.

*Primary Examiner*—John E. Murtagh

*Attorney, Agent, or Firm*—William R. McClellan

[57] ABSTRACT

A support pedestal assembly for a raised floor system can be used with metal panels or wood core panels, can be used with or without grid members, and can be used with brace members for resistance to vibration and seismic shock. The support pedestal assembly includes a pedestal base, a vertical, adjustable height support column coupled to the base, and a pedestal head coupled to the top of the support column. The pedestal head includes a center region for coupling to the support column and four arms, each having an aperture therethrough, extending outwardly from the center region. In one configuration, the arms form a 45 degree angle with the edges of the floor panel and a downwardly extending projection near the corner of the floor panel mates with the aperture in the arm to locate the panel on the pedestal assembly and to prevent horizontal movement. A floor panel corner locator can be mounted in the center region of the pedestal head for use in conjunction with the wood core floor panels.

12 Claims, 10 Drawing Figures

SUPPORT PEDESTAL ASSEMBLY FOR A RAISED FLOOR SYSTEM

CROSS REFERENCE TO RELATED APPLICATION

Rebentisch et al, "Floor Panel For A Raised Floor System", filed concurrently with the present application and assigned to the same assignee as the present application, discloses a floor panel which can be used in a raised floor system with the support pedestal assembly disclosed herein.

BACKGROUND OF THE INVENTION

This invention relates to raised floor systems and more particularly to support pedestal assemblies for modular raised floor systems.

Raised floor systems are commonly used in computer installations. The space between the raised floor and the subfloor is utilized for running interconnecting cables and air conditioning ducts. Raised floor systems are modular in construction and typically include floor panels supported at each corner by an adjustable height pedestal assembly, with each pedestal assembly supporting the corners of four abutting panels. Optional grid members, or stringers, connect adjacent pedestal assemblies to form a grid pattern. The grid members not only add strength to the system but also operate to properly space the pedestal assemblies on the subfloor. Various types of floor panels can be used, for example, metal or wood core.

Raised floor systems have been disclosed in various U.S. Patents. A pedestal assembly for raised floor systems is shown in U.S. Pat. No. 3,616,584 issued Nov. 2, 1971 to Sartori et al. The pedestal assembly disclosed by Sartori et al. can be utilized with or without grid members. When grid members are not used, studs inserted in the pedestal head prevent horizontal movement of the floor panel. Pedestal assemblies which can be utilized with or without grid members are also disclosed in U.S. Pat. No. 3,420,012 issued Jan. 7, 1969 to Liskey, Jr. et al. When grid members are not used, triangular projections on the pedestal head mate with apertures in the bottom surface of the floor panel to prevent horizontal movement. While such a configuration is generally satisfactory, it does not permit electro-deposition painting of the floor panel since the interior of the floor panel would fill with paint through the apertures in the bottom surface of the panel. Pedestal assemblies are also disclosed in U.S. Pat. No. 3,398,933 issued Aug. 27, 1968 to Haroldson and U.S. Pat. No. 3,470,663 issued Oct. 7, 1969 to Tate.

In the past, pedestal assemblies have been designed for use with a particular raised floor configuration. When the raised floor configuration was changed, the pedestal assembly was also changed. It would be advantageous to provide a universal pedestal assembly which can be utilized with metal or wood core floor panels, with or without grid members, and with or without brace members. Such a universal pedestal assembly would improve economies of production and distribution of a modular raised floor system.

SUMMARY OF THE INVENTION

According to the present invention, a support pedestal assembly for support of floor panels and grid members in a modular raised floor system includes a pedestal base, a vertical, adjustable height support column, and a pedestal head. The support column has a lower end coupled to the pedestal base and an upper end coupled to the pedestal head. The pedestal head includes a center region having means for coupling to the support column and four arms, each having an aperture therethrough, extending outwardly from the center region. Adjacent arms are at right angles and have a space therebetween. Each of the arms is adapted for receiving a generally U-shaped grid member which is coupled to the arm by a fastener element passing through the aperture in the arm when the raised floor system includes grid members. The space between the arms is, at its closest point to the center region, closer to the center region than the aperture in the arm so that when the raised floor system includes grid members and floor panels having a downwardly extending projection near each corner and when a corner of the floor panel rests over the center region and the pedestal head is aligned so that the arms are parallel to an edge of the floor panel, clearance exists between the pedestal head and the projection. Each of the apertures in the arms is located such that, when the raised floor system includes floor panels having a downwardly extending projection near each corner and is free of grid members and when a corner of the floor panel rests over the center region and the pedestal head is aligned so that the arms form a 45 degree angle with the edges of the floor panel, the projections mate with the apertures.

The center region can include means for mounting a floor panel corner locator which is utilized when the raised floor system includes floor panels with a flat bottom surface.

According to another aspect of the present invention, a raised floor system includes at least four support pedestal assemblies and at least one rectangular floor panel. Each pedestal assembly includes a pedestal base, a vertical, adjustable height support column having a lower end coupled to the pedestal base, and a pedestal head coupled to an upper end of the support column. The pedestal head includes a center region having means for coupling to the support column and four arms, each having an aperture therethrough, extending outwardly from the center region, adjacent arms being at right angles. The floor panel has a substantially flat top surface, four edges, four corners each resting over the center of one of the pedestal heads, and a downwardly extending projection near each corner. The pedestal head is aligned so that the arms form an angle with the edges of the floor panel. The apertures in the arms are located such that the projections in the floor panel mate with the apertures whereby the floor panel is located in relation to the pedestal head and is prevented from moving horizontally.

For a better understanding of the present invention, together with other and further objects, advantages and capabilities thereof, reference is made to the following disclosure and appended claims in connection with the above-described drawings.

DESCRIPTION OF THE PREFERRED EMBODIMENTS

The universal support pedestal assembly according to the present invention is utilized in a modular raised floor system. By utilizing several basic components, a variety of configurations can be constructed depending on the application of the raised floor system. The features and several configurations of the modular raised floor system are illustrated in FIGS. 1–4. An important feature of the support pedestal assembly disclosed herein is that it can be utilized in any of the illustrated configurations.

Figure 1:
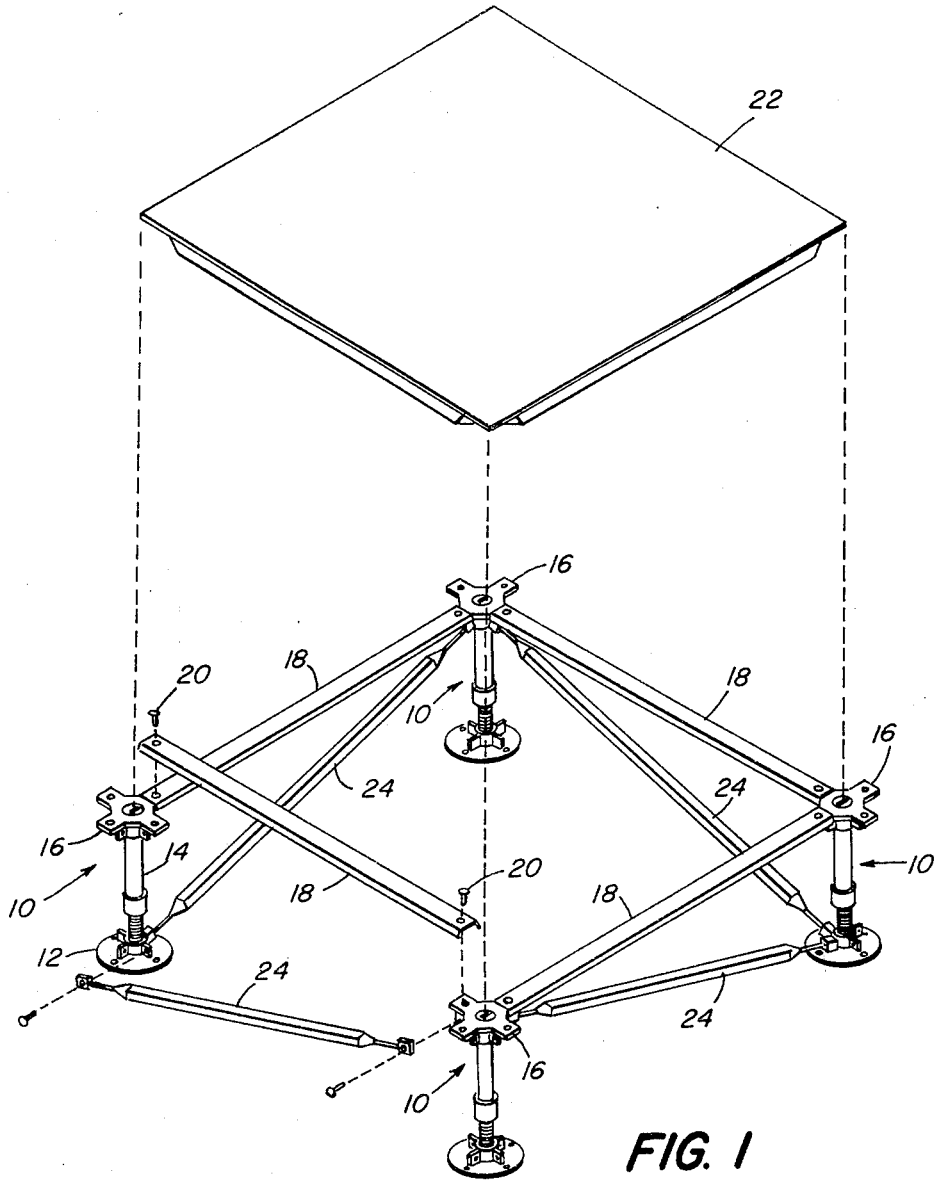
FIG. 1 is a perspective view, partially exploded, of a raised floor system with a metal floor panel, grid members, and brace members.

Referring to FIG. 1, there is shown one section of a raised floor system. Four support pedestal assemblies 10 rest on a horizontal surface, usually a subfloor. Each pedestal assembly 10 includes a pedestal base 12, a support column 14, and a pedestal head 16. Generally U-shaped grid members 18 are coupled between adjacent pedestal heads 16 to form a generally square framework when viewed from above. Grid members 18 can be fastened to each pedestal head 16 by standard self-tapping screws 20 or by plastic or nylon snap-in buttons (not shown). While grid members 18 are operative to add strength to the raised floor system and to assist in placement of pedestal assemblies 10 during installation of the raised floor system, they are not an essential element of the system as will be shown hereinafter. Metal floor panel 22 rests on support pedestal assemblies 10 and grid members 18 to form one section of a raised floor system. Each corner of floor panel 22 rests on the center of its respective support pedestal assembly 10 thereby permitting each pedestal assembly 10 to support one corner of each of four adjoining floor panels 22 (only one panel is shown). Thus, the raised floor system is extended by adding pedestal assemblies 10, grid members 18 and floor panels 22.

Also shown in FIG. 1 are optional brace members 24 which can be used to provide additional resistance to vibration and seismic shock. Each brace member 24 is coupled between a stiffener on one pedestal head 16 and a stiffener on an adjacent pedestal base 12.

Figure 2:
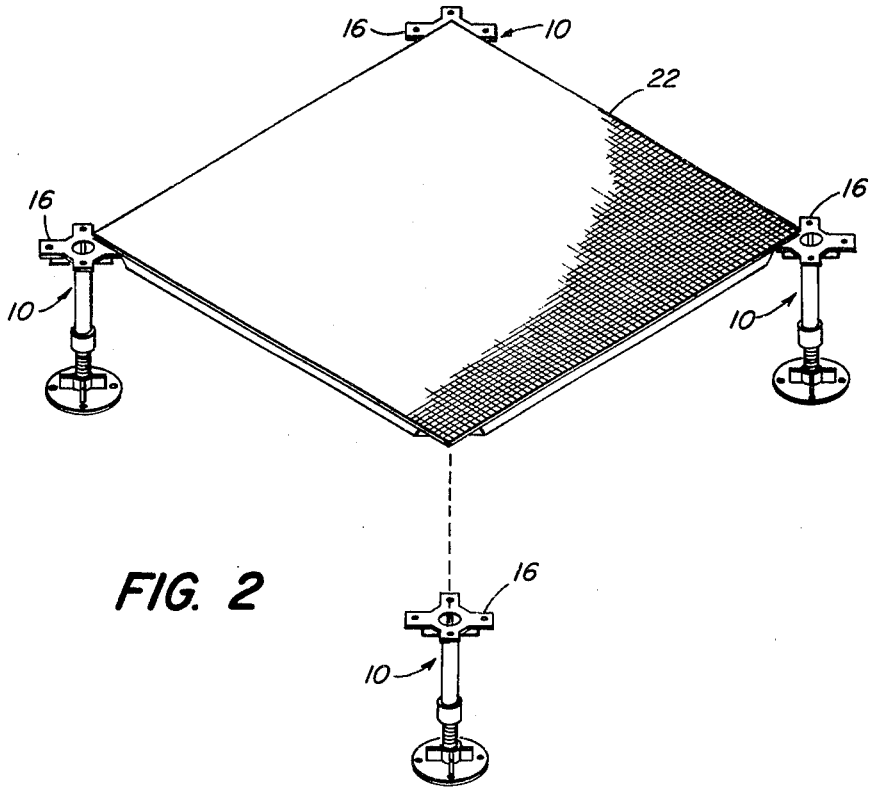
FIG. 2 is a perspective view, partially exploded, of a raised floor system with metal floor panels and not including grid members.

A raised floor system can be constructed without grid members as shown in FIG. 2. Support pedestal assemblies 10 are placed on a subfloor in the same relative positions as shown in FIG. 1 except that pedestal heads 16 are rotated by 45 degrees relative to the position shown in FIG. 1. Each corner of metal floor panel 22 rests on the center of its respective support pedestal assembly 10 thereby permitting each pedestal assembly 10 to support one corner of each of four adjoining floor panels 22 (only one panel is shown). The coupling between the pedestal assembly 10 and floor panel 22 is shown in more detail hereinafter.

Figure 3:
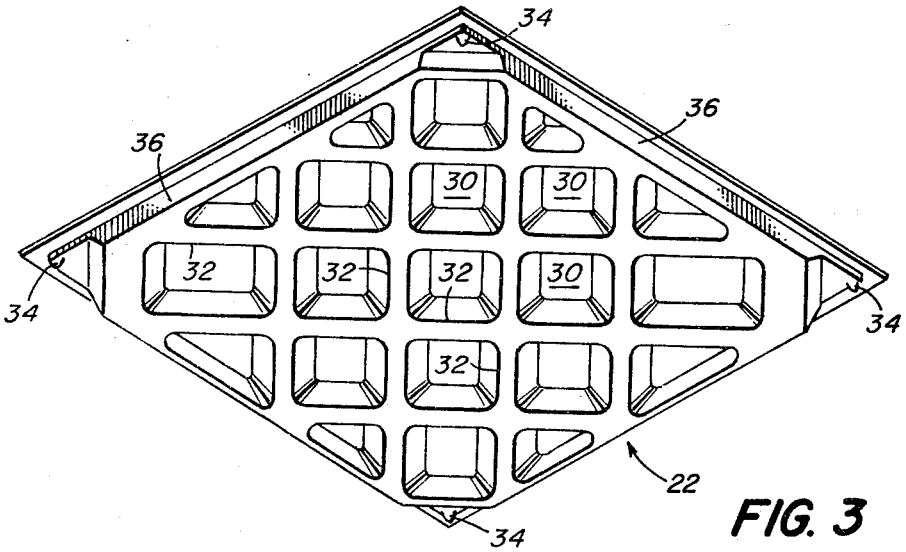
FIG. 3 is a bottom perspective view of the metal floor panel shown in FIGS. 1 and 2.

A bottom perspective view of metal floor panel 22 is shown in FIG. 3. It includes a generally flat top plate and a formed bottom member coupled to the top plate. The bottom member includes support regions 30 which are in contact with the top plate and box beams 32 which strengthen floor panel 22. The bottom member also includes downwardly extending projections 34 which are operative to locate panel 22 with respect to support pedestal assemblies 10 and to prevent it from moving horizontally in relation to pedestal assemblies 10 when grid members are not used. Also, when grid members are included in the raised floor system, box beam edges 36 form lips which abut the grid members and serve to locate panel 22 with respect to pedestal assemblies 10 and to prevent panel 22 from moving horizontally.

Figure 4:
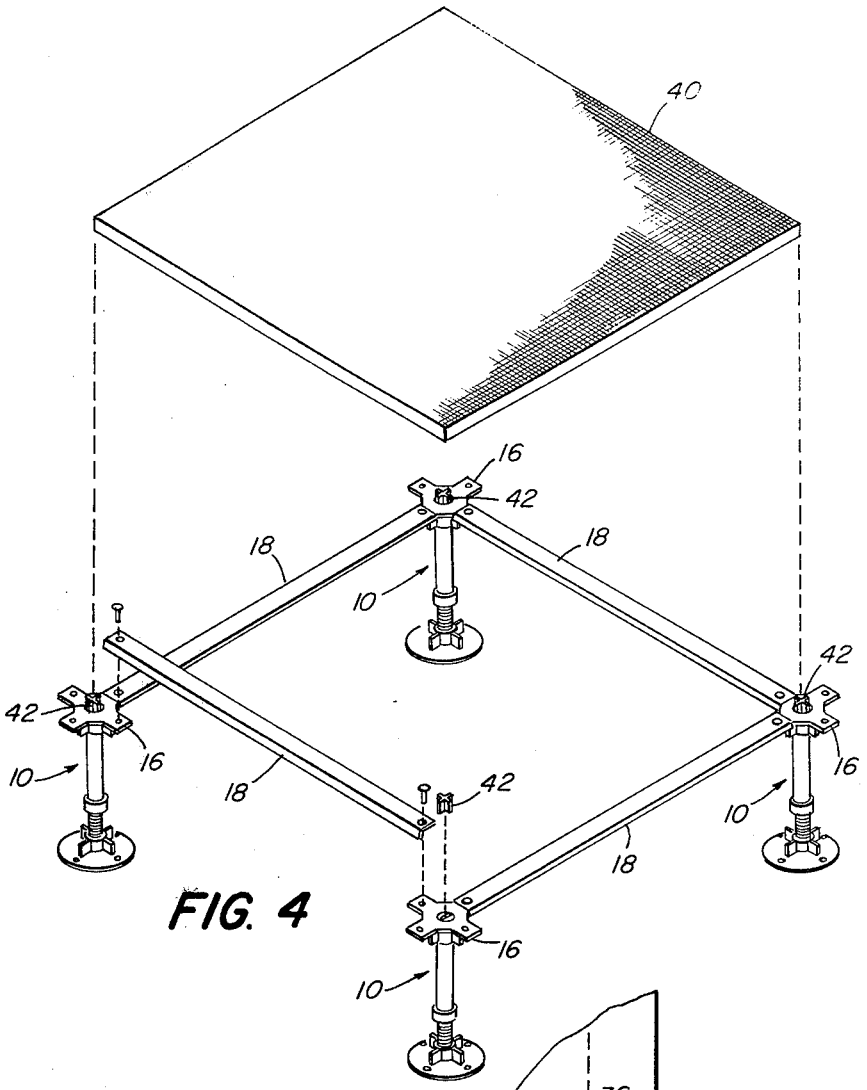
FIG. 4 is a perspective view, partially exploded, of a raised floor system with a wood core panel, grid members, and floor panel corner locators.

Another configuration of a raised floor system is illustrated in FIG. 4. Pedestal assemblies 10 and grid members 18 are configured as described above in connection with FIG. 1. A wood core floor panel 40 is mounted with its corners each resting on the center of a support pedestal assembly 10. While floor panel 40 is referred to as a wood core floor panel, it should be realized that the core can be plywood, composition board, or any other compression-resistant material. The bottom surface of wood core floor panel 40 is substantially flat. Therefore, floor panel corner locators 42 are used to prevent horizontal movement of floor panel 40. Each corner locator 42 is mounted in the center of pedestal head 16, is generally cross shaped and can be made of plastic or metal. The raised floor system configuration shown in FIG. 4 does not utilize brace members. However, brace members 24 can be included as shown in FIG. 1, when required.

Figure 5:
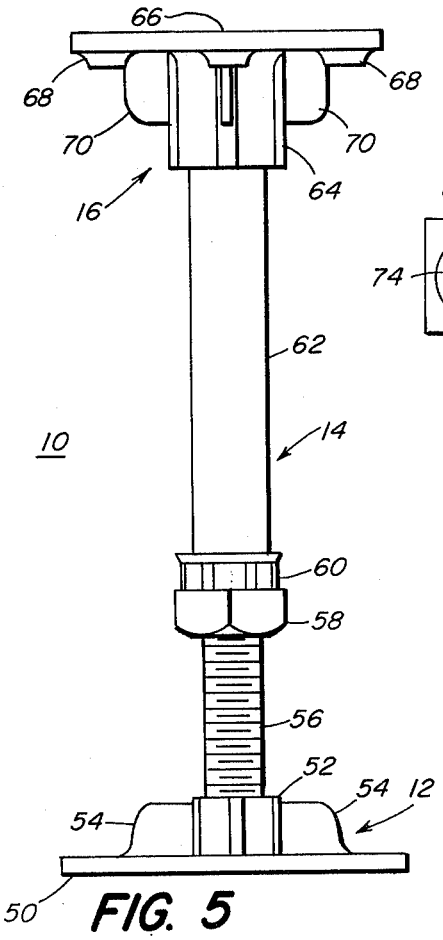
FIG. 5 is a side view of a support pedestal according to the present invention.
Figure 6:
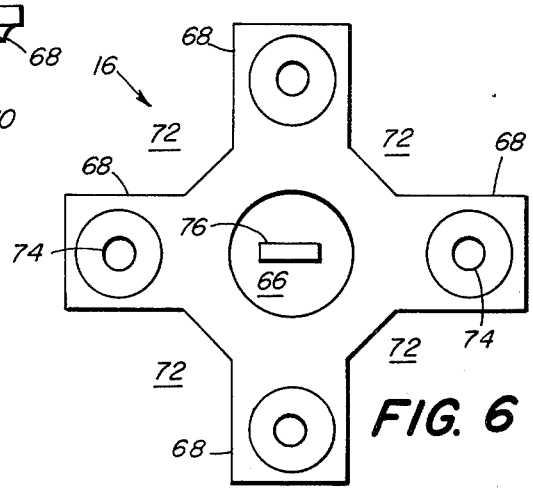
FIG. 6 is a top view of a pedestal head according to the present invention.

A preferred embodiment of a universal support pedestal assembly 10 according to the present invention is shown in FIG. 5. A pedestal head 16 is shown in FIG. 6. Pedestal assembly 10 includes pedestal base 12, vertical, adjustable length support column 14, and pedestal head 16. Pedestal base 12 includes a substantially flat bottom surface 50 for supporting pedestal assembly 10 on a horizontal subfloor and a cylindrical sleeve 52 on its top surface for receiving support column 14 which is press fit into sleeve 52. Pedestal base 12 also includes stiffeners 54 which support sleeve 52 against lateral movement. When mounting holes (not shown) are drilled through stiffeners 54, they can be used to couple pedestal assembly 10 to brace members 24 as shown in FIG. 1.

Support column 14 includes threaded member 56, nut 58, collar 60 and hollow tube 62. The lower end of threaded member 56 is pressed into sleeve 52 of pedestal base 12. Nut 58 is threaded onto threaded member 56. Collar 60 is pressed over the end of hollow tube 62 and the combination of collar 60 and hollow tube 62 slides over threaded member 56 and rests on nut 58. The height of pedestal assembly 10 is adjusted by turning nut 58 which causes collar 60 and hollow tube 62 to move up or down.

Pedestal head 16 includes cylindrical sleeve 64, center region 66, arm 68, and stiffeners 70. The upper end of hollow tube 62 is pressed into cylindrical sleeve 64 which extends downwardly from center region 66. Four arms 68 extend outwardly from center region 66 in the general shape of a cross as shown in FIG. 6. Adjacent arms 68 are at right angles to each other and have a space 72 therebetween. Each arm 68 has an aperture 74 therethrough which can be countersunk, as shown. Center region 66 can have an aperture such as slot 76 for mounting a floor panel corner locator as shown in FIG. 4. Center region 66 is shown in FIG. 6 as including a circular recess which operates to keep corner locator 42 centered on pedestal head 16. However, the circular recess in center region 66 is not a necessary feature and can be omitted, leaving center region 66 flat except for slot 76. The function of spaces 72, apertures 74 and slot 76 will be discussed more fully in connection with FIGS. 7, 8, and 9. Stiffeners 70 are located underneath, and provide support for, each arm 68. In addition, when mounting holes (not shown) are drilled through stiffeners 70, they can be used to couple pedestal assembly 10 to brace members 24 as shown in FIG. 1.

Figure 8:
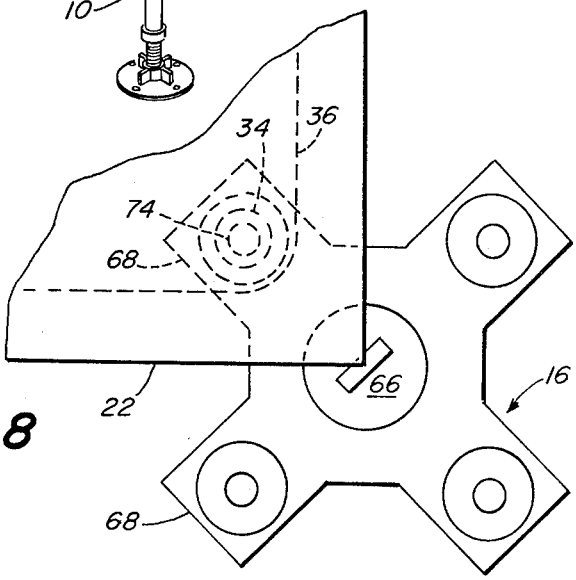
FIG. 8 is a top view illustrating the relation between the pedestal head and metal floor panel when grid members are not used.
Figure 9:
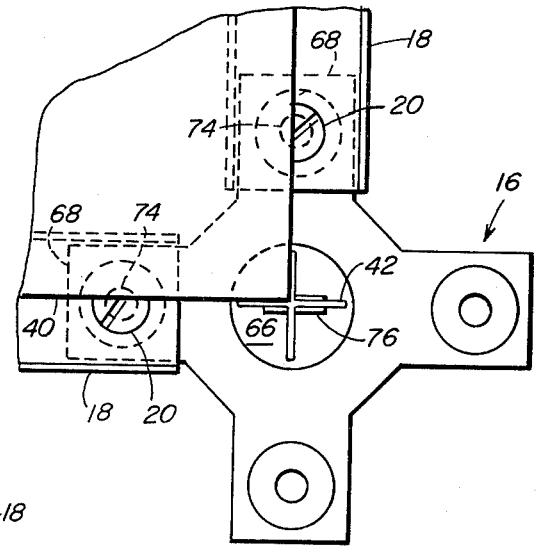
FIG. 9 is a top view illustrating the relation between the pedestal head, wood core panel, and corner locator when grid members are used.
Figure 7:
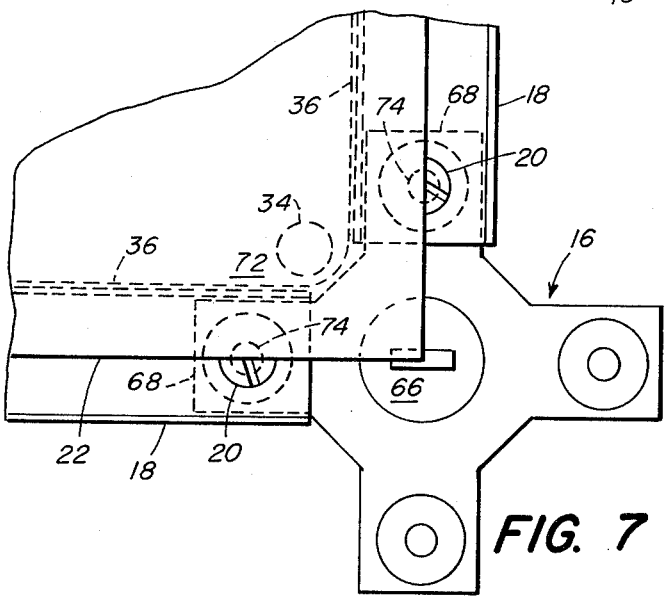
FIG. 7 is a top view illustrating the relation between the pedestal head and metal floor panel when grid members are used.

The universal feature of pedestal assembly 10 is illustrated in more detail in FIGS. 7, 8, and 9 which show the relation between the corner of the floor panel and the pedestal head in various raised floor systems. FIG. 7 shows the corner detail of the raised floor system of FIG. 1 which includes grid members and metal floor panels. Grid members 18 are coupled to arms 68 of pedestal head 16 by a fastener element, typically a self-tapping screw 20 or a plastic or nylon snap-in button (not shown), which passes through aperture 74. Metal floor panel 22 rests on grid members 18 with the corner of floor panel 22 resting over center region 66. Pedestal head 16 is aligned so that arms 68 are parallel to an edge of floor panel 22. Each space 72 between adjacent arms 68 is, at its closest point to center region 66, closer to center region 66 than apertures 74 in arms 68 so that, in this configuration, clearance exists between projection 34 on metal floor panel 22 and pedestal head 16. Box beam edges 36 form lips which abut grid members 18 and serve to locate panel 22 with respect to pedestal head 16 and to prevent horizontal movement of panel 22. In a typical raised floor system, three other floor panels 22 (not shown) are supported by pedestal head 16, one in each quadrant.

FIG. 8 shows the corner detail of the raised floor system of FIG. 2 which includes metal floor panels and does not include grid members. Pedestal head 16 is aligned so that arms 68 form a 45 degree angle with the edges of metal floor panel 22. Downwardly extending projection 34 on metal floor panel 22 mates with aperture 74 in arm 68 to positively locate panel 22 with respect to pedestal head 16 and to prevent horizontal movement of panel 22. The corner of floor panel 22 rests over center region 66. In a typical raised floor system, three other floor panels 22 (not shown) are supported by pedestal head 16, one in each quadrant.

FIG. 9 shows the corner detail of the raised floor system of FIG. 4 which includes wood core floor panels and grid members. Grid members 18 are coupled to arms 68 of pedestal head 16 by a fastener element, typically a self-tapping screw 20 or a plastic or nylon snap-in button (not shown), which passes through aperture 74. Wood core floor panel 40 rests on pedestal head 16 and grid members 18 with the corner of floor panel 40 resting over center region 66. Pedestal head 16 is aligned so that arms 68 are parallel to an edge of floor panel 40. Since the bottom surface of wood core floor panal 40 is substantially flat, grid members 18 do not prevent horizontal movement of panel 40. Therefore, in this configuration floor panel corner locator 42 is mounted in slot 76 in pedestal head 16. Corner locator 42 is a cross-shaped member which extends vertically above pedestal head 16 and operates to locate panel 40 with respect to pedestal head 16 and to prevent horizontal movement of panel 40. In a typical raised floor system three other floor panels 40 (not shown) are supported by pedestal head 16, one in each quadrant.

Figure 10:
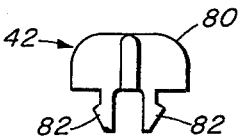
FIG. 10 is a side view of a floor panel corner locator.

FIG. 10 is a side view of floor panel corner locator 42 which is viewed from the top in FIG. 9. Corner locator 42 includes a cross-shaped upper portion 80 and two tabs 82 which secure corner locator 42 in a rectangular aperture. Corner locator 42 is typically made of nylon or plastic, but can be metal.

While there has been shown and described what is at present considered the preferred embodiments of the invention, it will be obvious to those skilled in the art that various changes and modifications may be made therein without departing from the scope of the invention as defined by the appended claims.

We claim:

1. A raised floor system comprising:

at least four support pedestal assemblies, said pedestal assemblies each including a pedestal base, a vertical, adjustable height support column having a lower end coupled to said pedestal base, and a pedestal head coupled to an upper end of said support column, said pedestal head including a center region having means for coupling to said support column and four arms, each having an aperture therethrough, extending outwardly from said center region, adjacent arms being at right angles; and at least one rectangular floor panel having a substantially flat top surface, four edges, four corners each resting over the center of one of said pedestal heads, and a downwardly extending projection near each corner, said pedestal head being aligned so that said arms form an angle with the edges of said floor panel and said apertures in said arms being located such that the projections in said floor panel mate with said apertures whereby said floor panel is located in relation to said pedestal head and is prevented from moving horizontally.

2. The raised floor system as defined in claim 1 wherein said rectangular floor panel is square.

3. The raised floor system as defined in claim 2 wherein said means for coupling to said support column includes a cylindrical sleeve for receiving said support column.

4. The raised floor system as defined in claim 3 wherein said pedestal head further includes stiffener elements, located below each of said arms, which provide support for said arms.

5. The raised floor system as defined in claim 4 wherein the angle between said arms and the edges of said floor panel is 45 degrees.

6. The raised floor system as defined in claim 5 wherein said floor panel includes a generally flat top plate and a formed bottom member coupled to the top plate, said bottom member including support regions in contact with said top plate and box beams which strengthen said floor panel.

7. A universal support pedestal assembly which can be used in a first raised floor system configuration with floor panels of a first type, each having a downwardly extending projection near each corner thereof, in a second raised floor system configuration with floor panels of said first type and elongated grid members coupled between adjacent pedestal assemblies, and in a third raised floor system configuration with floor panels of a second type, having a generally flat bottom surface, and elongated grid members coupled between adjacent pedestal assemblies, said floor panels in each of said raised floor system configurations having a rectangular shape including four edges and four corners and being supported at each corner thereof by one of said pedestal assemblies, said support pedestal assembly comprising:

a pedestal base;

a vertical, adjustable height support column having a lower end coupled to said pedestal base; and a pedestal head coupled to an upper end of said support column, said pedestal head including a center region having means for coupling to said support column and having an aperture in the center of said pedestal head for mounting a floor panel corner locator which is utilized in said third raised floor system configuration and four arms, each having an aperture therethrough and extending outwardly from said center region, adjacent arms being at right angles and having a space therebetween, each of said apertures in said arms being spaced from said center region at a distance adapted for providing mating engagement with one of the projections on said floor panel of the first type in said first raised floor system configuration when said pedestal head is aligned so that said arms form a 45 degree angle with the edges of the floor panel, each of said arms being adapted for coupling, in said second raised floor system configuration, to one of said grid members by a fastener element passing through said aperture, and each of said spaces between said arms being, at its closest point to said center region, closer to said center region than said aperture in said arm, said spaces between said arms thereby being adapted for providing, in said second raised floor system configuration, clearance between one of the projections on said floor panel of the first type and said pedestal head when said arms are aligned parallel to the edge of said floor panel.

8. The pedestal assembly as defined in claim 7 wherein said aperture in the center of said pedestal head includes a rectangular slot.

9. The pedestal assembly as defined in claim 8 wherein said means for coupling to said support column includes a cylindrical sleeve for receiving said support column.

10. The pedestal assembly as defined in claim 9 wherein said pedestal head further includes means for coupling to braces, said coupling means being located below each of said arms and being configured to support said arms and wherein said pedestal base further includes means for coupling to braces.

11. The pedestal assembly as defined in claim 10 wherein said center region of said pedestal head includes a circular recess which is operative, in said third raised floor system configuration, to center said floor panel corner locator on said pedestal head.

12. The pedestal assembly as defined in claim 7 wherein said pedestal head further includes stiffener elements, located below each of said arms, which provide support for said arms.

* * * * *